US006533679B1

(12) United States Patent
McCabe et al.

(10) Patent No.: US 6,533,679 B1
(45) **Date of Patent: *Mar. 18, 2003**

(54) HOLLOW GOLF CLUB

(75) Inventors: Terrill R. McCabe, Carlsbad, CA (US); Peter J. Gilbert, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/544,670

(22) Filed: Apr. 6, 2000

(51) Int. Cl.[7] ..... A63B 53/04; A63B 53/06; A63B 53/08

(52) U.S. Cl. ..... 473/335; 473/334

(58) Field of Search ..... 473/334–340, 473/341, 345, 326

(56) References Cited

U.S. PATENT DOCUMENTS

| | | | | | |
|---|---|---|---|---|---|
| 1,538,312 | A | * | 5/1925 | Beat | 473/337 |
| 2,002,108 | A | | 5/1935 | Child | |
| 2,163,091 | A | * | 6/1939 | Held | 473/338 |
| 2,171,383 | A | | 8/1939 | Wettlaufer | |
| 2,198,981 | A | * | 4/1940 | Sullivan | 473/338 |
| 2,225,930 | A | * | 12/1940 | Sexton | 473/338 |
| 2,257,575 | A | * | 9/1941 | Reach | 473/338 |
| 2,750,194 | A | * | 6/1956 | Clark | 473/337 |
| 2,846,228 | A | | 8/1958 | Reach | |
| 3,610,630 | A | * | 10/1971 | Glover | 473/338 |
| 3,637,218 | A | | 1/1972 | Carlino | |
| 4,043,563 | A | * | 8/1977 | Churchward | 473/338 |
| 4,085,934 | A | * | 4/1978 | Churchward | 473/338 |
| 4,180,269 | A | | 12/1979 | Thompson | |
| 4,313,607 | A | * | 2/1982 | Thompson | 473/328 |
| 4,319,752 | A | * | 3/1982 | Thompson | 473/328 |
| 4,519,612 | A | | 5/1985 | Tsao | |
| 4,602,787 | A | | 7/1986 | Sugioka et al. | |
| 4,630,825 | A | | 12/1986 | Schmidt et al. | |
| 4,645,207 | A | | 2/1987 | Teramoto et al. | |
| 4,667,963 | A | | 5/1987 | Yoneyama | |
| 4,708,347 | A | | 11/1987 | Kobayashi | |
| 4,795,159 | A | | 1/1989 | Nagamoto | |
| 4,803,023 | A | | 2/1989 | Enomoto et al. | |
| 4,834,387 | A | | 5/1989 | Waites et al. | |
| 4,867,458 | A | | 9/1989 | Sumikawa et al. | |
| 4,869,507 | A | | 9/1989 | Sahm | |
| 4,884,812 | A | | 12/1989 | Nagasaki et al. | |
| 5,050,879 | A | | 9/1991 | Sun et al. | |
| 5,056,705 | A | | 10/1991 | Wakita et al. | |
| 5,193,811 | A | | 3/1993 | Okumoto et al. | |
| 5,294,037 | A | | 3/1994 | Schmidt | |
| 5,348,302 | A | | 9/1994 | Sasamoto et al. | |
| 5,386,996 | A | | 2/1995 | Hiruta et al. | |
| 5,421,577 | A | | 6/1995 | Kobayashi | |
| 5,501,459 | A | | 3/1996 | Endo | |

(List continued on next page.)

OTHER PUBLICATIONS

Callister, Jr., William D., Materials Science and Engineering: An Introduction, 4th Edition., New York: John Wiley and Sons, Inc copyright 1997, pp. 775–776.*

*Primary Examiner*—Paul T. Sewell
*Assistant Examiner*—Alvin A. Hunter
(74) *Attorney, Agent, or Firm*—Swidler Berlin Shereff Friedman LLP

(57) ABSTRACT

A golf club head, wherein the head comprises a front striking face, a back plate, a toe wall, a heel wall, and a sole plate, configured to form an interior cavity; a hosel and a bore for receiving a shaft; at least one chamber formed inside the interior cavity by a plurality of wall members and one of the front striking face, back plate, toe wall, heel wall, and sole plate; a weight member disposed within the chamber; and a filler material juxtaposed the weight member and the wall members forming the cavity such that the weight member is isolated from the wall members and is securely held within the chamber.

20 Claims, 8 Drawing Sheets

U.S. PATENT DOCUMENTS 5,533,725 A 7/1996 Reynolds, Jr.
5,582,553 A * 12/1996 Ashcraft et al. ..... 473/345
5,614,143 A * 3/1997 Hager ..... 264/221
5,683,310 A 11/1997 Chen
5,720,674 A 2/1998 Galy
5,774,970 A 7/1998 Huang
5,776,011 A 7/1998 Su et al.
5,807,188 A * 9/1998 Serrano et al. ..... 473/338
5,899,821 A * 5/1999 Hsu et al. ..... 473/332
5,913,735 A 6/1999 Kenmi
5,935,019 A 8/1999 Yamamoto
6,206,789 B1 * 3/2001 Takeda ..... 473/335
6,248,025 B1 * 6/2001 Murphy et al. ..... 473/324

* cited by examiner

HOLLOW GOLF CLUB

FIELD OF THE INVENTION

The present invention relates to golf clubs and, more particularly, to a golf club head that has internal components that allow adjustment of the weight and position of the center of gravity within the club head.

BACKGROUND OF THE INVENTION

There are many different types of golf clubs on the market today available to recreational and professional golfers alike. These clubs include irons, woods, and specialty clubs, such as putters, wedges, and trouble/difficult lie clubs. From the hundreds of choices, golfers face a sometimes overwhelming task when deciding what clubs best suit their game. Golf clubs are generally selected based on a number of criteria, such as shaft length, loft, lie angle, head size, head construction, and swing weight. All of these different clubs are available because of the infinite number of shots that golfers encounter, each and every one of which are played with varying swing types. Because recreational golfers exhibit so many different swings, a club that one golfer hits well, another hits poorly. One type of club, however, that most recreational golfers, and even some professionals, have trouble hitting, are the long irons, such as a 2-iron or a 3-iron. This is because the club face of a 2-iron or a 3-iron is constructed with a low degree of loft. Woods are generally considered to be easier to hit than are irons of the same loft. Woods, however, do not typically afford recreational golfers the same control that irons do.

Although there have been many efforts by manufacturers to make long irons easier to hit or to give wood-type clubs the control afforded by irons, the results of these efforts have, for the most part, been unsuccessful.

U.S. Pat. No. 5,056,705 discloses a method of manufacturing a golf club head having a hollow section, a sole face, and a sole closure. The hollow section of the club head may contain a balance weight mounted to the rear side of the sole closure. No preferred materials for the balance weight are disclosed.

U.S. Pat. No. 5,193,811 discloses a wood type golf club head comprising a head body consisting mainly of a synthetic resin, and a metallic sole plate bonded to the lower surface of the head body. The sole plate has on its surface various members formed integrally therewith which include a hosel on the heel side, weights on the toe side and rear side, and a beam connecting the weights and the hosel. Auxiliary weights, such as brass, tungsten, lead, and zinc, may be added to more specifically position the specific gravity. The auxiliary weights are either buried within the standard weights or are fitted over projections in the surface of the standard weights in a lock-and-key fashion.

U.S. Pat. No. 5,913,735 discloses a golf club head including a hollow head body having a bottom opening and a sole member, both of which are made of titanium or an alloy thereof. An upwardly-opened weight-fitting concave portion is formed on an inner surface of the sole member and a protrusion is formed on the inner surface of the concave portion. A metallic weight is forcibly fitted into the concave portion and the protrusion of the concave portion is forcibly inserted in the bottom surface of the weight so that the weight is fixed in the concave portion. The weight material is preferably lower in hardness and larger in specific gravity than titanium, such as brass or lead.

U.S. Pat. No. 5,935,019 discloses a metallic hollow golf club head comprising a sole plate and a weight of a heavy metal. The sole plate is formed from a light metal and contains a fitting hole. The weight is press-fitted into the fitting hole and extends into the cavity.

It is the intention of the present invention, therefore, to develop a golf club that bridges the gap between irons and woods. The concept of constructing an iron-type golf club that hits like a wood-type club is a novel effort in which the cavity of a wood is coupled with an iron, allowing novel variations to swing weight, weight position (heel or toe weighting), and center of gravity to be adjusted to a particular golfers swing.

The swing weight, in particular, is a club property that takes into consideration the weight of all of the club's components including the head, the shaft, and the grip. Many golfers would prefer to have the swing weight of their clubs match to their individual needs, a feat generally accomplished by custom-making clubs for the golfer. Since custom clubs are expensive, many golfers cannot afford to have the swing weight of their clubs properly matched to their game and swing. As stated above, because club manufacturers must limit the number of clubs that they design and produce, the number of clubs having different swing weights are obviously limited. It is therefore desirable to both golfers and manufacturers to have clubs available in which the swing weight is adjustable after the club is formed. It is the object of the present invention to develop a club head that bridges the gap between irons and woods and further allows customization of the swing weight of the club head in small increments.

SUMMARY OF THE INVENTION

The present invention is directed to a golf club head, wherein the head comprises a front striking face, a back plate, a toe wall, a heel wall, and a sole plate, configured to form an interior cavity; a hosel and a bore for receiving a shaft; at least one chamber formed inside the interior cavity by a plurality of wall members and one of the front striking face, back plate, toe wall, heel wall, and sole plate; a weight member disposed within the chamber; and a filler material juxtaposed the weight member and the wall members forming the cavity such that the weight member is isolated from at least one of the wall members and is securely held within the chamber.

In one embodiment, the chamber is attached to the sole plate. Preferably, the chamber is further attached to at least one of the front striking face, back plate, toe wall, or heel wall. In another embodiment, the weight member is of unitary construction. In a preferred embodiment, the weight member has a horizontal cross-section that is substantially rectangular and a vertical cross-section that is substantially square. In another embodiment, the weight member has an inhomogeneous longitudinal thickness. Preferably, the weight member has a mass of between about 55 grams and about 110 grams.

In still another embodiment, the club head has a first mass and the weight member has a second mass that is between about 25% and 50% of the first mass. The weight member can be symmetrically disposed within the chamber or, alternatively, the weight member can be isolated from the all of the wall members by a plurality of supports. Preferably, the weight member comprises tungsten, copper, molybdenum, lead, alloys thereof, and mixtures thereof. In another embodiment, the weight member comprises a plurality of weight member parts. In yet another embodiment, the weight member parts each have different densities.

In one embodiment, the sole plate has at least one aperture for receiving a plug. In another embodiment, the aperture is threaded. In still another embodiment, the chamber has a first volume and the weight member has a second volume that is greater than about 50% of the first volume. Preferably, the second volume is greater than about 80% of the first volume.

In another embodiment, the filler material is selected from the group consisting of adhesive, glue, caulking material, thermosetting or thermoplastic resins, epoxy, and mixtures thereof. In a preferred embodiment, the filler material is epoxy.

The present invention is also directed to a metal-wood club head, wherein the head comprises a front striking face, a back plate, a toe wall, a heel wall, a sole plate, a crown, and an arcuate skirt, configured to form an interior cavity; hosel and a bore for receiving a shaft; at least one chamber formed inside the interior cavity by a plurality of wall members and one of the front striking face, back plate, toe wall, heel wall, sole plate, crown, and arcuate skirt; a weight member disposed within the chamber; and a filler material juxtaposed the weight member and the wall members forming the cavity such that the weight member is isolated from at least one of the wall members and is securely held within the chamber.

DETAILED DESCRIPTION OF THE INVENTION

Figure 1A:
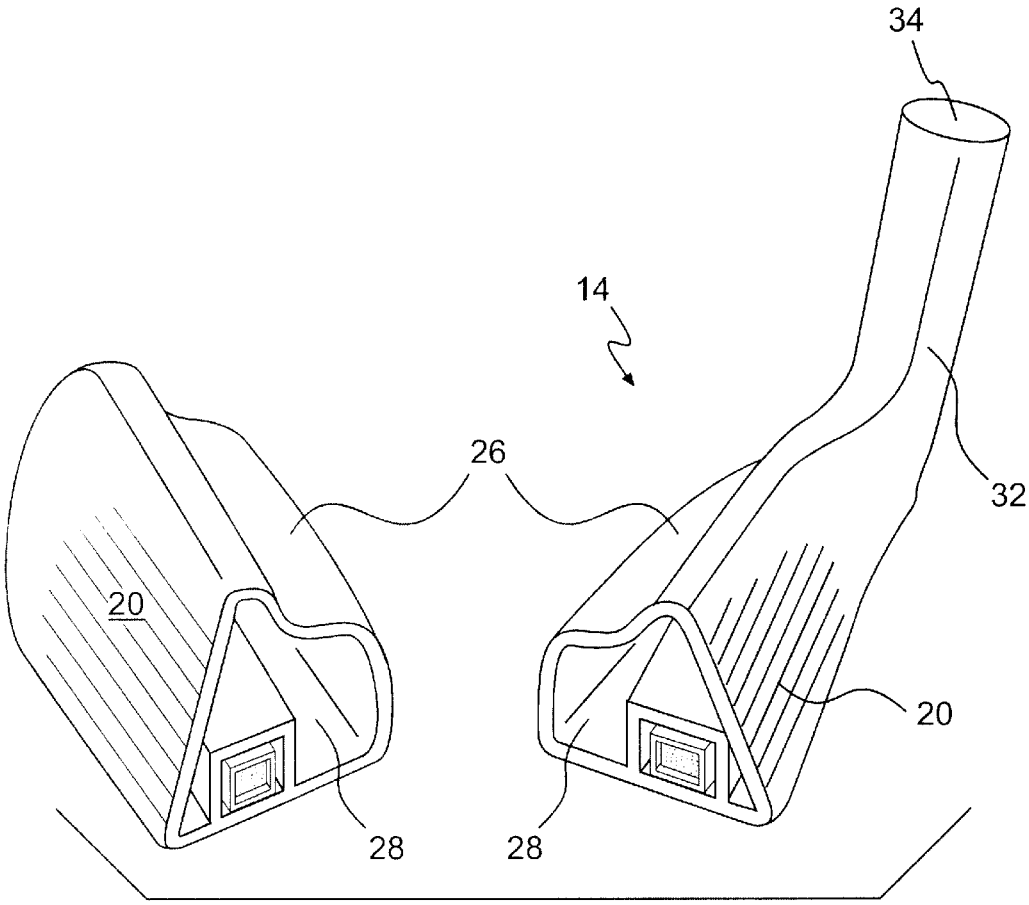
FIG. 1A is a cross-sectional view of the head of the present invention.
Figure 1B:
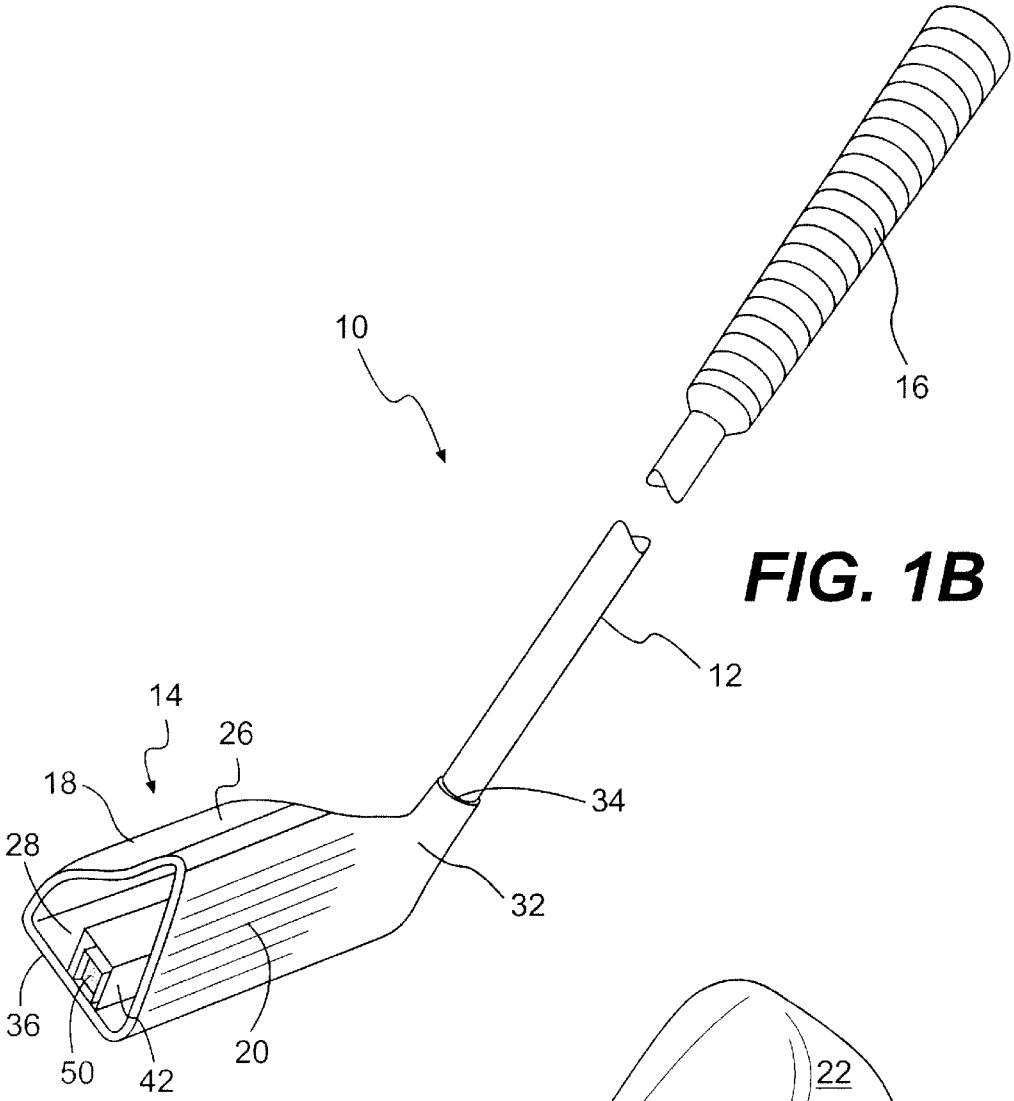
FIG. 1B is a front, perspective view of a golf club of the present invention.
Figure 1C:
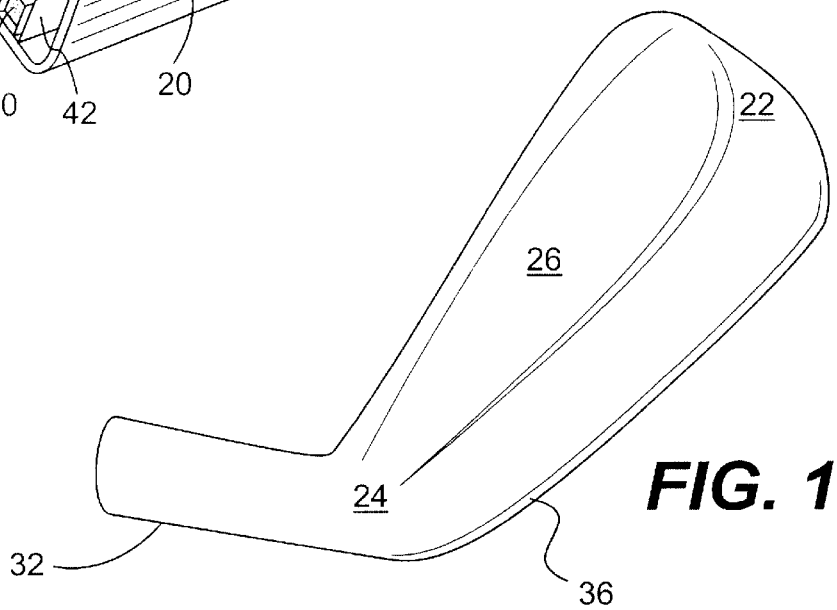
FIG. 1C is a back, perspective view of the golf club of the present invention.

Referring to FIGS. 1A–1C, a golf club 10 has a shaft 12 (only partially shown) with a club head 14 and a grip 16 attached to opposing ends. The club head 14 has a body 18 including a front striking face 20, a toe wall 22, a heel wall 24, and a back plate 26, the combination of which define a cavity 28 rearward of the front striking face 20. The golf club further contains a hosel 32 having a bore 34 for receiving a shaft 12.

Figure 2A:
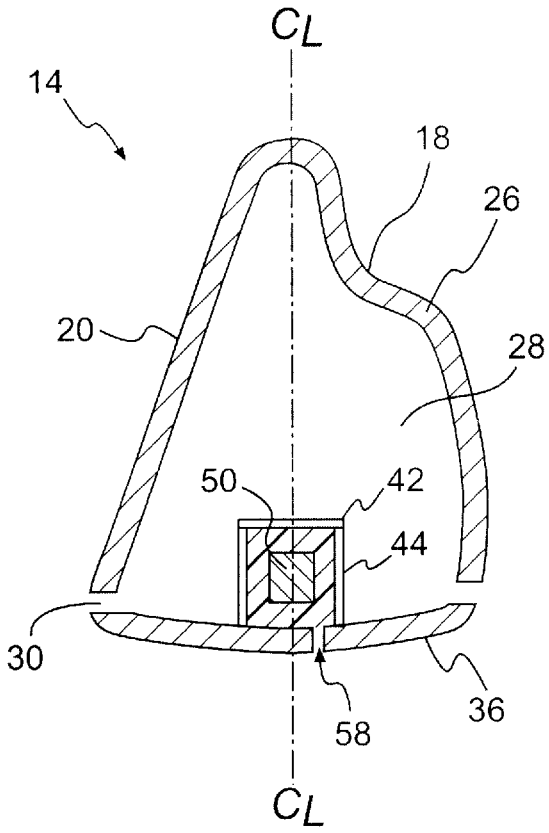
FIG. 2A is a horizontal cross-sectional view of the head of the present invention.

Referring to FIGS. 1B and 2A, the body 18 defines a bottom opening 30. The club head 14 further includes a sole plate 36, which is configured to cover the opening in the bottom of the body 18. In the preferred embodiment, the golf club head is formed of two separate pieces: the body 18 and the sole plate 36, which is preferably an assembly comprising a plurality of components, such as a chamber, cap plate, weight member, and a filler, that are discussed in more detail below. However, in other embodiments, the club head can be formed of at least three parts, as is well-known to one of ordinary skill in the art.

Referring to FIGS. 1A–2A, a hosel 32 extends from the heel wall 24. The hosel 32 defines a bore 34 for accepting the shaft 12. The bore 34 in the hosel 32 can be a conduit into the interior cavity 28. In one embodiment, the hosel 32 forms a shaft through the body 18 of the club head 14 to a lower corner portion of the sole plate 36. The sole plate 36 is preferably of unitary construction but may include an aperture to receive the shaft 12. In this embodiment, the shaft 12 extends through the entire club head 14 to the aperture in the sole plate 36. In the preferred embodiment, the hosel 32 contains an aperture for receiving the shaft 12 that does not extend through the hosel 32 into the interior cavity 28.

Figure 3A:
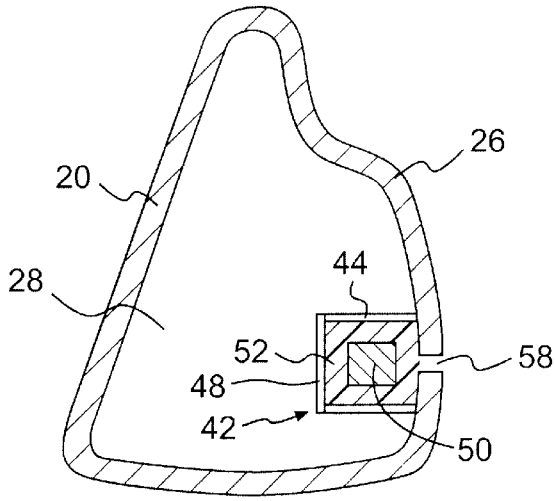
FIG. 3A is a cross-sectional view showing another embodiment of the club head of the present invention where the chamber is attached to the back plate.
Figure 3B:
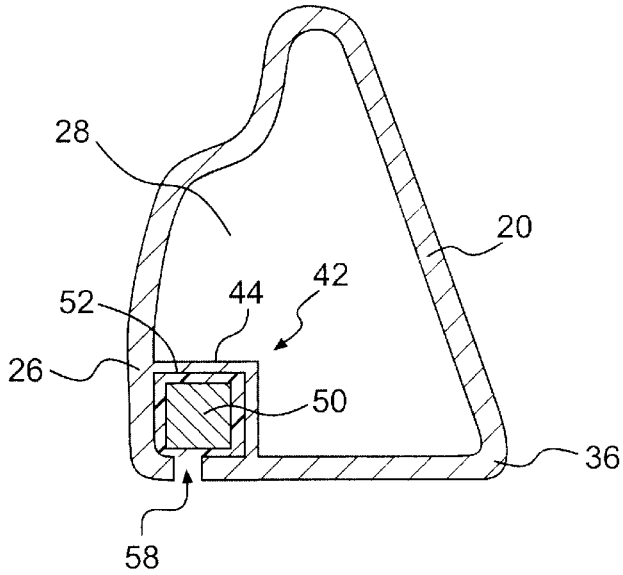
FIG. 3B is a cross-sectional view showing another embodiment of the club head of the present invention where the chamber is attached to the sole plate and the back plate simultaneously.
Figure 3C:
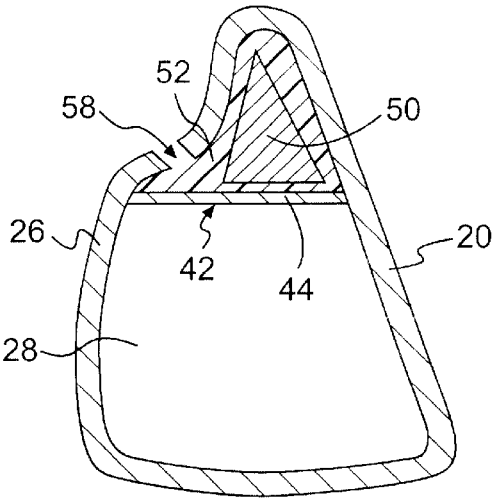
FIG. 3C is a cross-sectional view showing another embodiment of the club head of the present invention where the chamber is defined by the inner surfaces of the front striking face, the back plate, and the sole plate.

As seen in FIG. 1B, the cavity 28 of the club head 14 includes a chamber 42 coupled to and extending from the interior surface of the cavity 28. The chamber 42 is defined by a wall structure having a chamber volume therein. The chamber 42 is preferably attached to the sole plate 36, but could, for example, be attached to the inside of the front striking face 20, the back plate 26, the top of the cavity 28, or to both the front striking face 20 and the sole plate 36 simultaneously, as depicted in FIGS. 3A–3C. Preferably, the chamber 42 includes at least one side wall member 44, at least one end wall member 46, and a cap 48. In one embodiment, damping material is placed between the walls of the chamber 42 and the inner cavity surface. In another embodiment, the sole plate 36 and chamber 42 are formed separately and connected using conventional techniques, such as by welding or gluing.

Figure 2B:
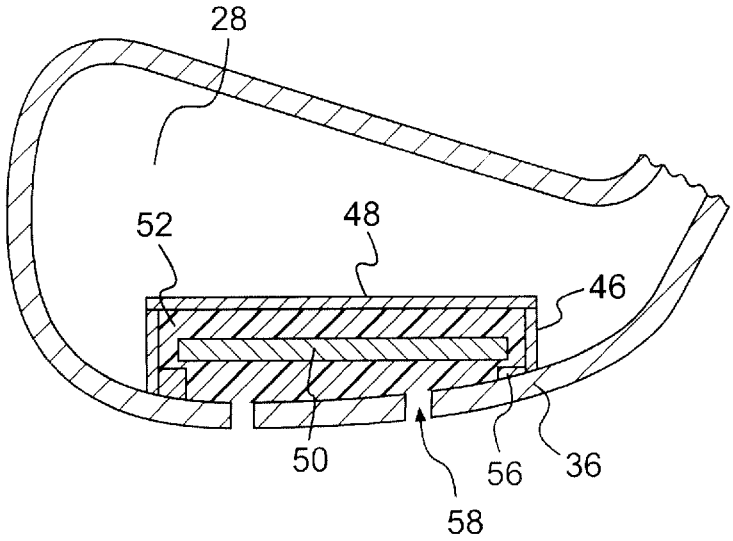
FIG. 2B is a vertical cross-sectional view of the head of the present invention.

Referring to FIGS. 2A and 2B, the chamber 42 preferably has a horizontal cross-section that is rectangular in shape and a vertical cross-section that is square in shape, defined by the at least one side wall member 44 and the at least one end wall member 46, but could also have a non-symmetrical or non geometric (no mirror image) cross-section, such as a triangular cross-section or one that follows the profile of sole plate 36. In an alternative embodiment, the chamber 42 has walls that are not perpendicular to the sole plate 36, such as walls defined by a pyramidal structure.

The cap 48 is preferably of unitary construction and may be attached to the chamber 42 by a plurality of means including welding, gluing, press fitting, or by a tongue and groove manner. The preferred method for securing the cap 48 to the chamber 42 is by press fitting. The cap 48 may also be formed integrally with the wall members. The cap 48 may additionally contain "cleats" to secure any contents therein.

Referring to FIGS. 2A and 2B, the chamber 42 is disposed on the sole plate 36 so that it is generally centered with respect to the centerline, $C_L$, of the club head 14. As a result, the chamber 42 is generally centered between the heel wall 24 and the toe wall 22 in the transverse direction within the club head 14. The chamber 42 may also be adjacent the rearmost edge of the sole plate 36 or the back plate 26 of the club head, as depicted in FIGS. 3A and 3B.

In a preferred embodiment of the present invention, the chamber 42 contains at least one weight member 50 and a filler material 52 disposed therein. The weight member 50 is disposed in the chamber 42 and the filler material 52 is juxtaposed in the remaining volume. Referring to FIGS. 3A–5C, the weight member 50 can be any structure, such as a rectangle or square, or have any cross-section, such as a rectangular or triangular cross-section. Preferably the weight member 50 is rectangular in both shape and cross-section. The weight member 50 may be of unitary construction or it may comprise a plurality of weight member parts 54, such as depicted in FIGS. 6A–6C. The weight member parts may be of the same or of differing material or densities. If the weight member 50 comprises two materials of differing densities, they may be in the form of layers or two pieces end-to-end to allow the center of gravity of the club head 14 to be adjusted in a number of ways, such as up/down, front/back, or heel/toe. The weight member parts 54 may be separate or attached together by a plurality of means, such as by welding, gluing, or press-fitting. In one embodiment, the volume of the weight member 50 is greater than about 50% of the volume of the chamber 42. In a preferred embodiment, the volume of the weight member 50 is greater than about 80% of the volume of the chamber 42. The weight member 50 can be constructed of any material. Recommended weight member materials are tungsten, copper, molybdenum, lead, alloys thereof, and mixtures thereof. Preferably, the material has a different density than the density of the club head material. However, the present invention is not limited to these weighted materials, for example a weighted material like molten metal can be liquified and poured into the chamber where it can harden. The preferred weighted material is tungsten or tungsten powder, for example the commercially available tungsten powder manufactured by Polese.

Figure 5A:
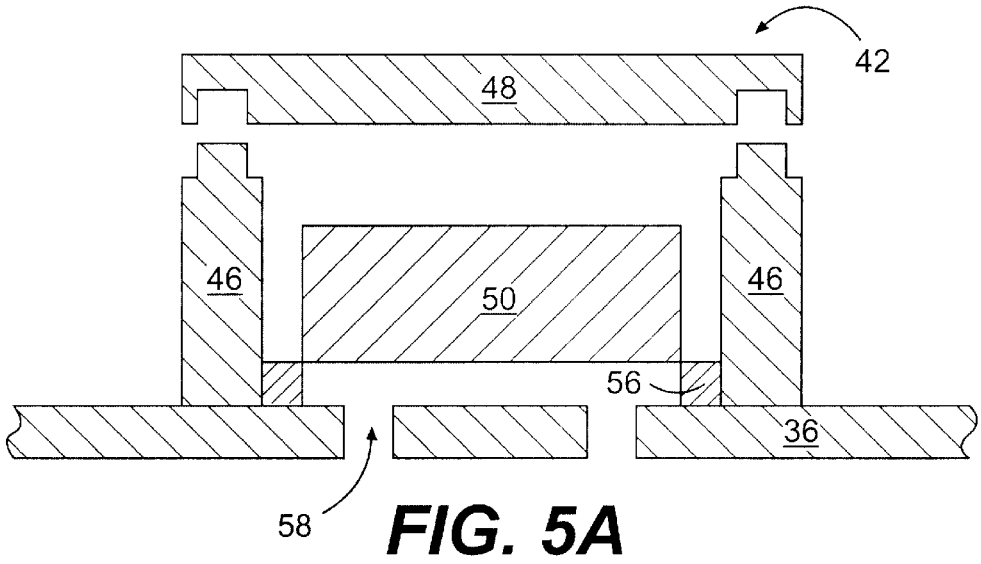
FIG. 5A is a cross-sectional view showing another embodiment of the chamber of the present invention where the weight member is supported in the chamber by support members.
Figure 5B:
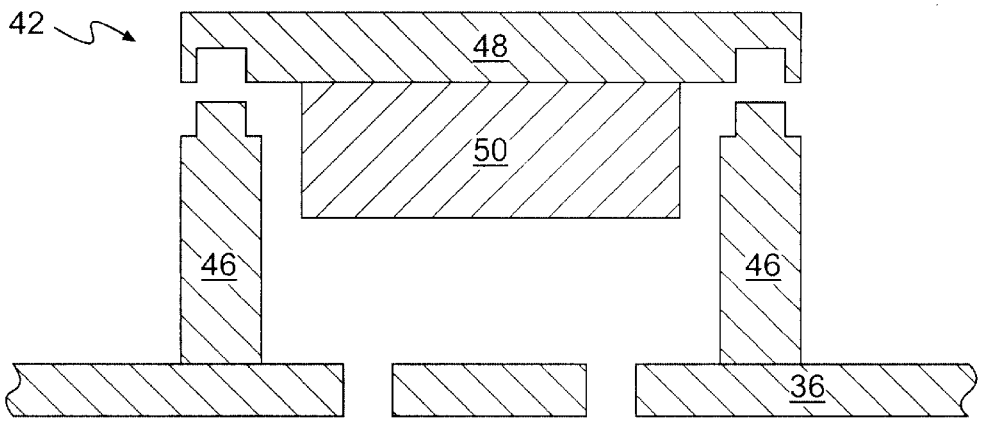
FIG. 5B is a cross-sectional view showing another embodiment of the chamber of the present invention where the weight member is secured in the chamber by attachment to the cap.
Figure 5C:
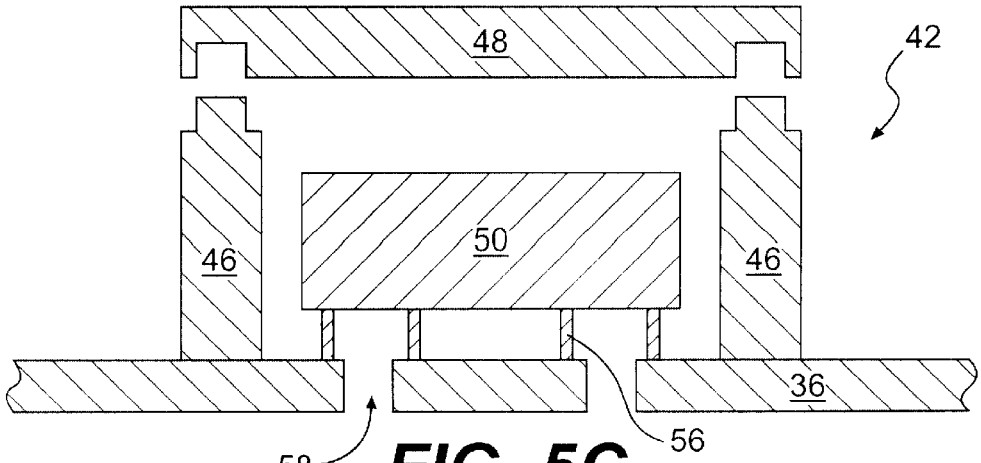
FIG. 5C is a cross-sectional view showing another embodiment of the chamber of the present invention where the weight member is supported in the chamber by pins.
Figure 6A:
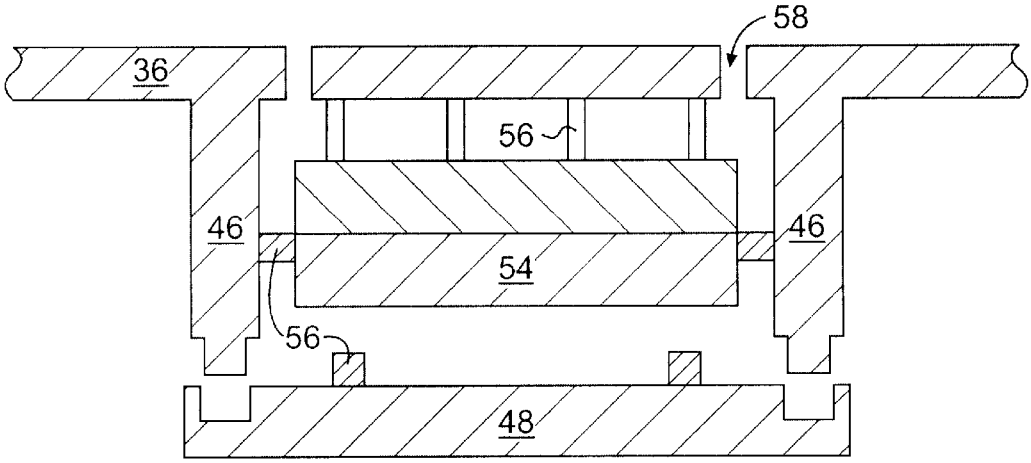
FIG. 6A is a cross-sectional view showing another embodiment of the chamber of the present invention where the weight member comprises two layers of differing material and is secured in the chamber by a plurality of support members.
Figure 6B:
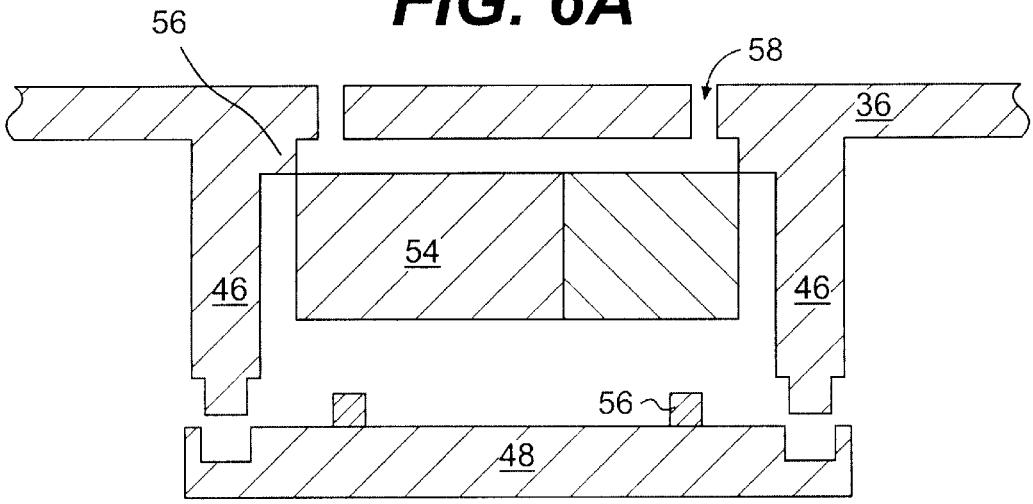
FIG. 6B is a cross-sectional view showing another embodiment of the chamber of the present invention where the weight member comprises two blocks of differing material and is secured in the chamber by support members.
Figure 6C:
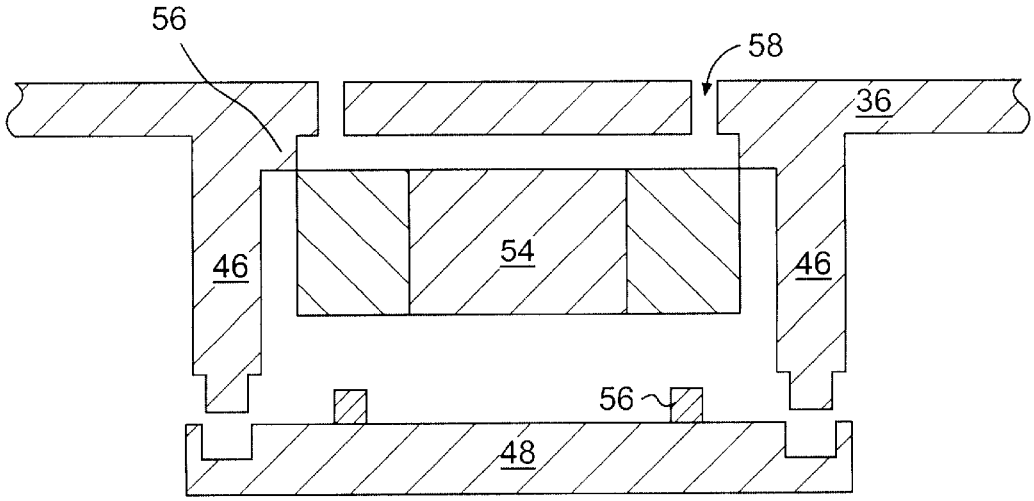
FIG. 6C is a cross-sectional view showing another embodiment of the chamber of the present invention where the weight member comprises three blocks of differing material, one material disposed between two blocks of the second material, and is secured in the chamber by support members.

Referring to FIGS. 5A–5C, the weight member 50 may be placed in the chamber 28 in any location but is preferably in the center. If the weight member 50 comprises a non-uniform shape or contains materials of differing densities, it may be mounted such that heavy section is either toeward or heelward to provide the club head 14 with toe or heel weighting. The weight member 50 is typically held in center of the chamber 42 by supports 56 located, for example, in the comers of chamber 42 such that the weight member 50 has a void on all sides. Preferably, the weight member 50 is symmetrically disposed within the chamber. However, the location of the weight member 50 within the chamber may be asymmetrical as desired by the manufacturer to allow for adjustment of the center of gravity of the club head 14. The center of gravity may be adjusted a number of ways, including, but not limited to, up/back, front/rear, and heel/toe. The supports 56 may have any shape or dimension but preferably have a small volume and cross-section compared to that of the weight member 50. The supports 56 may be of differing heights such that weight member 50 is held at an angle with respect to the cap 48 or the at least one side wall member 44. For example, the weight member 50 may be supported in center of the chamber 42 by a plurality of pins on the sole plate 36. If desired, the supports 56 may be shaped to aid in securing the weight member 50 within the chamber 42. In one embodiment, the weight member 50 attached to the optional cap 48. If desired, a damping material may be placed between the cap 48 and the weight member 50. In a further embodiment, the weight member is secured by a spring-like structure that provides pressure against the weight member 50 and the at least one side wall member 44 or cap 48.

Referring again to FIGS. 2A and 2B, the filler material 52 is disposed between the weight member 50, the walls of the chamber 42, and the sole plate 36, to aid in securing the weight member 50 within the chamber 42. The volume of the weight member 50 and the volume of the filler material 52 substantially equals the volume of the chamber 42. The weight member 50 preferably has a predetermined weight, density, or specific gravity, that allows the weight distribution in the club head 14 to be altered prior to manufacture. The center of gravity may be adjusted a number of ways, including, but not limited to, up/back, front/rear, and heel/toe. The filler material 52 should have a weight that is substantially less than the weight of the weight member 50. Since the filler material 52 weighs substantially less than the weight member 50, the club head 14 is configured such that the weight member 50 is suspended or spaced from the sole plate within the club head. In one embodiment, however, at least a portion of the weight member 50 penetrates through the sole plate 36 such that it is exposed to the outside of the club head 14.

FIG. 2A is a preferred embodiment of the present invention. The chamber 42 is disposed within the cavity 28 of the club head 14 such that it is centered along the center line, $C_L$, on the sole plate 36. As described above, the chamber 42 can be of any construction, but is preferably a rectangular structure having two side wall members 44, two end wall members 46, and a cap 48. Disposed within the chamber 42 is the preferred weight member 50, a rectangular structure. The weight member 50 is disposed within the chamber 42, such that it is symmetrically separated from the side wall members 44, the end wall members 46, and the cap 48. The void between these chamber parts allows the remaining volume of the chamber 42 to be filled with a filler material 52, such as an epoxy. Preferably the filler material 52 is placed within the chamber 42 through at least one aperture 58 in the sole plate 36.

FIGS. 3A–3C depict alternative embodiments of the current invention. In one embodiment, the chamber 42 is attached to the back plate 26. In another embodiment, the chamber 42 is attached simultaneously to the sole plate 36 and the back plate 26. In still another embodiment, the chamber 42 is formed by connecting the inner surfaces of the front striking face 20 and the back plate 26 with a side wall member 44. If desired, the weight member 50 may be altered in shape so as to substantially fit the cavity created by the side-wall member 44, the front striking face 20, and the back plate 26. It should be obvious to one of ordinary skill in the art that these different embodiments allow precise control of the center of gravity within the club head 14 in a variety of directions and/or locations.

Figure 4A:
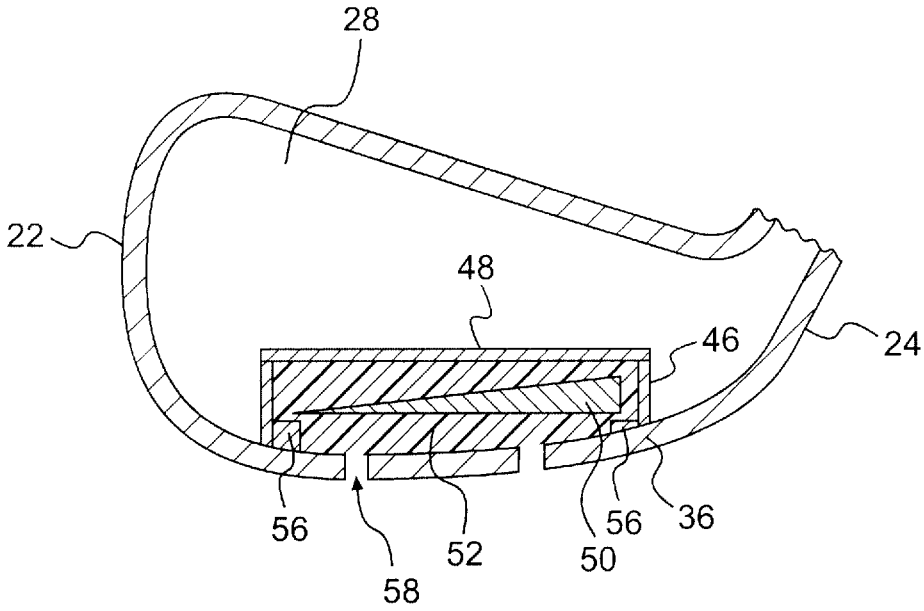
FIG. 4A is a cross-sectional view showing another embodiment of the club head of the present invention where the weight member provides heel weighting by having increasing thickness in the toe to heel direction.
Figure 4B:
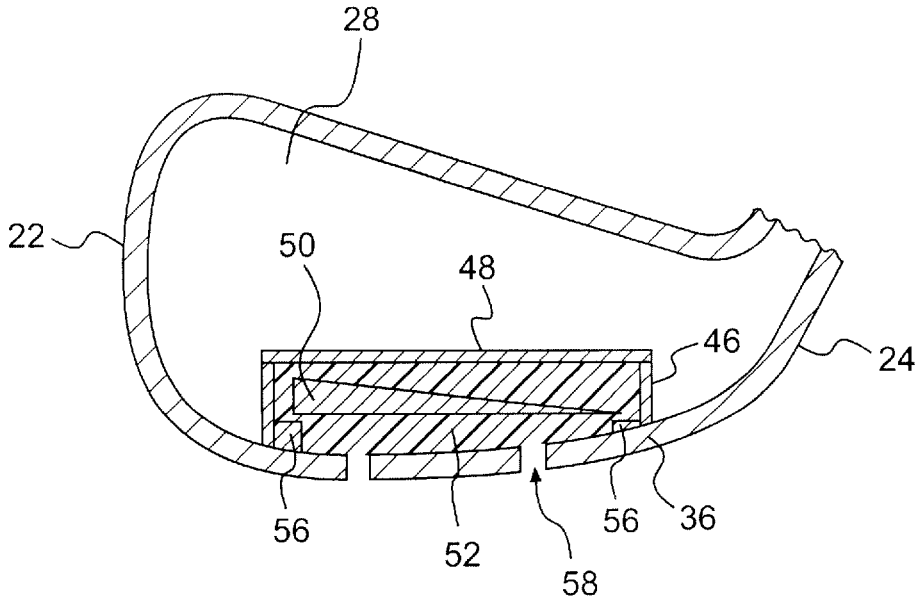
FIG. 4B is a cross-sectional view showing another embodiment of the club head of the present invention where the weight member provides toe weighting by having increasing thickness in the heel to toe direction.

In an alternative embodiment, as seen in FIGS. 4A and 4B, the weight member 50 located within the chamber 42 is constructed in a non-symmetrical geometry. By varying the thickness of the weight member 50, the center of gravity can be precisely positioned at a predetermined point between the heel wall 24 and the toe wall 22.

Referring to FIGS. 5A through 5C, alternative embodiments for enclosing the chamber are depicted. In FIG. 5A, the weight member 50 rests on supports 56 located between the end walls 46 which are all attached to the sole plate 36. The chamber 42 is enclosed by attaching a cap 48 in a tongue and groove manner. FIG. 5B depicts another embodiment of the present invention in which the weight member 50 is secured to the cap 48 before enclosing the chamber 42. In another embodiment of the chamber 42, as can be seen in FIG. 5C, the weight member 50 is supported with the volume of the chamber 42 by a plurality of supports 56, such as pins.

Referring now to FIGS. 6A–46C, alternative embodiments of current invention are depicted that involve weight members comprising weight member parts 54. Preferably, the weight member parts 54 are of two different materials, each having a substantially different density. In FIG. 6A, the weight member 50 comprises two layers different materials adhered to each other. The at least two parts of the weight member 50 may be secured together in any manner, such as by welding or gluing. The weight member 50, as seen in FIG. 6A, is held in the center of the chamber 42 by a plurality of supports 56. The at least two materials that comprised the weight member 50, are preferably of differing densities, such that the center of gravity of the club head 14 may be adjusted. The center of gravity may be adjusted a number of ways, including, but not limited to, up/back, front/rear, and heel/toe. FIG. 6B depicts a weight member 50 comprised of at least two differing materials, preferably of differing densities, such that the center of gravity of the club head 14 may be adjusted between the heel and toe of the club. FIGS. 6C depicts a weight member 50 having at least two differing materials with one material of a first density being located between two pieces of a second material having a second density. Again, this multiple material weight member 50 allows the manufacturer to have fine control over the location of the center of gravity within the club head 14.

Moreover, the weight members allow the manufacturer to have fine control over the final weight of the club head such that the club head weight can be adjusted for different swing weights and/or different weighted shafts. For example, weight members 50 can come in various sizes, e.g., large and small, to accommodate changing the club head weight without altering any other parameters.

The sole plate 36 preferably has at least one aperture 58 such that access to the interior volume of the chamber 42 is provided. It is through this aperture 58 that the filler material 52 enters the chamber 42. In one embodiment, the sole plate 36 contains a second aperture 58 to allow air to escape as the filler material 52, preferably epoxy or glue, enters the void around weight member 50. When the volume of the chamber 42 is full of filler material 52, the at least one aperture 58 receives a threaded or press-fit plug 60. If desired, an epoxy-like material may be used to secure the plug 60.

The filler material 52 has a fluid state so that it is injectable into the chamber 42 through the aperture 58. The filler material 52 also has a set state where the material has changed into a solid or gel. Once the filler material sets, it secures the weighted material within the chamber in its respective section. Recommended filler materials include, but are not limited to, adhesive, glue, such as hot melt, caulking material or thermosetting resins, thermoplastic resins, epoxy, or mixtures thereof. Preferably, the filler material 52 is epoxy.

In the preferred embodiment, the plug 60 is formed of plastic and has a truncated conical shape. The plug 60 is sized so that when it is inserted into the threaded aperture 58, the threads of the aperture 58 dig into the surface of the plug 60 and secure the plug within the sole plate 36. An adhesive, glue or epoxy is applied to the plug 60 prior to insertion in the sole plate to further secure it therein. The use of the adhesive, glue, or epoxy with the plug is optional.

Dimensions, such as the internal diameter and height, of the at least one side wall member 44 and end wall member 46, can vary depending on the weight requirements desired. Similarly, the thickness and diameter of the cap 48 can vary. The dimensions of these components dictate the volume of the chamber 42 and, thus, the maximum volume of weight member 50 and filler material 52 that is disposed therein. One of ordinary skill in the art can determine the dimensions of the at least one side wall member 44, at least one end wall member 46, and cap 48 depending on the desired chamber volume.

The weight member 50 preferably has mass of between about 55 grams and about 110 grams. The mass of the weight member 50, in a more preferred embodiment, is about 75 grams. The mass of the weight member 50 is typically between about 25% and about 50% of the total mass of the club head 14. Preferably, the mass of the weight member 50 is typically between about 35% and about 40% of the total mass of the club head 14.

The body 14 and sole plate 36 are typically cast from conventional materials. The toe wall 22, heel wall 24, and back plate 26 may be cast integrally with the sole plate 36. The chamber 42 is attached to the inner surface of the cavity 28 as desired. Preferably, the chamber 42 is attached to the sole plate 36. If desired, the aperture 58 is also cast into the sole plate in a location corresponding to the chamber 42. Once these components are formed, the sole plate 36 is attached to the body 14, such as by welding. The internal threads in the aperture 58 are formed by conventional methods.

In one embodiment, a water-based foam is injected into the interior cavity 28 of the club head 14 through the hosel bore 34. In another embodiment, the cavity 28 may be filled, partially or fully, with a foam material, such as polyurethane, by way of the bore 34 and plurality of holes therein. In another embodiment, a conventional means, such as a bore through one of the body walls, is used to fill the interior cavity with foam.

In another embodiment of the current invention, directed to a metal-wood type club head, the club head comprises a crown and an arcuate skirt. The metal wood further contains a hosel having a bore for receiving a shaft. The front striking face, the toe wall, the heel wall, the back plate, the sole plate, the crown, and the arcuate skirt, are combined to form a body having a cavity. The chamber of the current invention may be attached to any interior surface of the cavity. Preferably, the chamber is attached to the sole plate in the manner described above. In an additional embodiment, the chamber may be attached to the crown of the metal wood to allow the center of gravity of the club head to be raised. Additionally, at least one chamber may be attached to various locations on the crown such that the center of gravity is further placed towards the heel or the toe of the club head. The center of gravity may also be adjusted a number of other direction, such as up/back or front/rear.

Figure 7A:
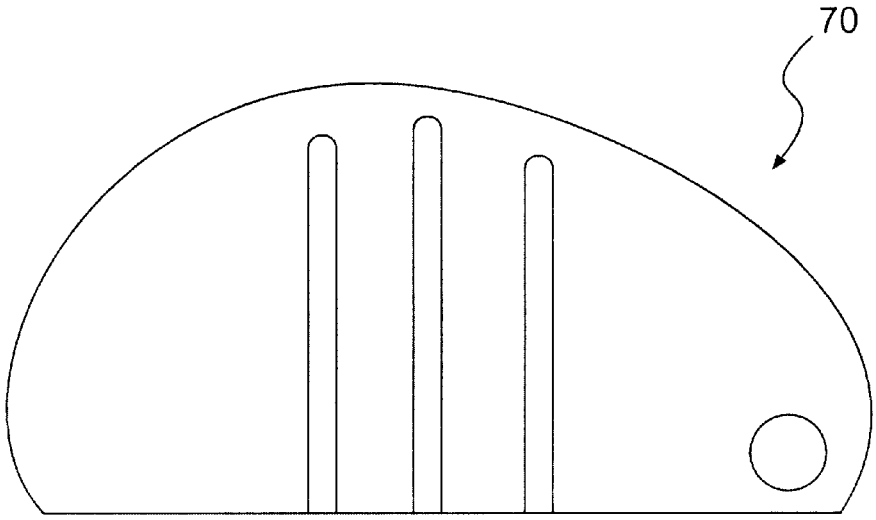
FIG. 7A is a top view showing another embodiment of the present invention where the weight member is in a club head such as a putter.
Figure 7B:
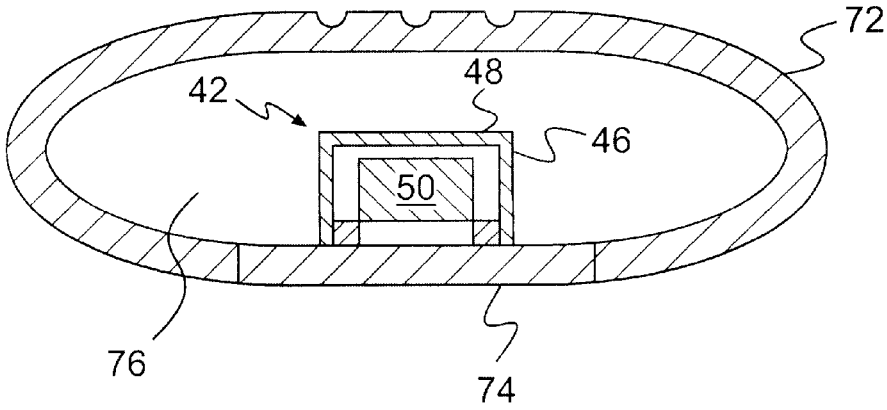
FIG. 7B is a cross-sectional view showing another embodiment of the present invention where the weight member is contained in a chamber defining a putter club head and is located on a removable sole plate.

Referring to FIGS. 7A and 7B, an alternative embodiment of the present invention is directed to a putter, such as a mallet-style putter 70. The club head of the putter generally comprises a hollow body 72, forming a cavity, and a sole plate 74. The putter further contains a hosel 76 having a bore for receiving a shaft. The chamber 42 of the present invention may be attached to any interior surface of the cavity 76 or the sole plate 74. Preferably, the chamber is attached to the sole plate 74 in the manner described above. The chamber 42 may also be attached to a variety of locations on the inner surface of the cavity 76 to allow the center of gravity of the putter to be adjusted, such as towards the heel or the toe, up/back, or front/rear of the club head. In an alternative embodiment, the sole plate 74 is removable such that chambers having a different mass may be added or changed.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf club head, wherein the head comprises:

a front striking face, a back plate, a toe wall, a heel wall, and a sole plate, configured to form an interior cavity;

a hosel and a bore for receiving a shaft;

at least one substantially closed chamber formed inside the interior cavity by a plurality of wall members and one of the front striking face, back plate, toe wall, heel wall, and sole plate;

a weight member disposed within the chamber; and a filler material juxtaposed the weight member and the wall members forming the cavity such that the weight member is isolated from at least one of the wall members and is securely held within the chamber.

2. The club head of claim 1, wherein the chamber is attached to the sole plate, and wherein the chamber includes side walls and a lid to close the chamber and enclose the weight member and the filler material.

3. The club head of claim 2, wherein the chamber is further attached to at least one of the front striking face, back plate, toe wall, or heel wall.

4. The club head of claim 1, wherein the weight member is of unitary construction.

5. The club head of claim 1, wherein the weight member has a horizontal cross-section that is substantially rectangular and a vertical cross-section that is substantially square.

6. The club head of claim 1, wherein the weight member has an inhomogeneous longitudinal thickness.

7. The club head of claim 1, wherein the weight member has a mass of between about 55 grams and about 110 grams.

8. The club head of claim 1, wherein the club head has a first mass and the weight member has a second mass that is between about 25% and 50% of the first mass.

9. The club head of claim 1, wherein the weight member is symmetrically disposed within the chamber.

10. The club head of claim 1, wherein the weight member is isolated from all of the wall members by a plurality of supports.

11. The club head of claim 1, wherein the weight member comprises tungsten, copper, molybdenum, lead, alloys thereof, and mixtures thereof.

12. The club head of claim 1, wherein the weight member comprises a plurality of weight member parts.

13. The club head of claim 12, wherein the weight member parts each have different densities.

14. The club head of claim 1, wherein the sole plate has at least one aperture for receiving a plug.

15. The club head of claim 14, wherein the aperture is threaded.

16. The club head of claim 1, wherein the chamber has a first volume and the weight member has a second volume that is greater than about 50% of the first volume.

17. The club head of claim 16, wherein the second volume is greater than about 80% of the first volume.

18. The club head of claim 1, wherein the filler material is selected from the group consisting of adhesive, glue, caulking material, thermosetting or thermoplastic resins, epoxy, and mixtures thereof.

19. The club head of claim 18, wherein the filler material is epoxy.

20. A metal-wood club head, wherein the head comprises:

a front striking face, a back plate, a toe wall, a heel wall, a sole plate, a crown, and an arcuate skirt, configured to form an interior cavity;

a hosel and a bore for receiving a shaft;

at least one chamber formed inside the interior cavity by a plurality of wall members and one of the front striking face, back plate, toe wall, heel wall, sole plate, crown, and arcuate skirt;

a weight member disposed within the chamber; and a filler material juxtaposed the weight member and the wall members forming the cavity such that the weight member is isolated from at least one of the wall members and is securely held within the chamber.

* * * * *